US011408190B2

(12) United States Patent
Lange

(10) Patent No.: US 11,408,190 B2
(45) Date of Patent: Aug. 9, 2022

(54) AUTOMATED BUILDING WASHING APPARATUS

(71) Applicant: Michael R. Lange, Little Canada, MN (US)

(72) Inventor: Michael R. Lange, Little Canada, MN (US)

( * ) Notice: Subject to any disclaimer, the term of this patent is extended or adjusted under 35 U.S.C. 154(b) by 0 days.

(21) Appl. No.: 17/134,376

(22) Filed: Dec. 26, 2020

(65) Prior Publication Data

US 2021/0198910 A1 Jul. 1, 2021

Related U.S. Application Data

(60) Provisional application No. 62/953,864, filed on Dec. 26, 2019.

(51) Int. Cl.

| | |
|---|---|
| ***E04G 23/00*** | (2006.01) |
| ***A47L 1/02*** | (2006.01) |
| ***E04G 3/32*** | (2006.01) |
| ***A46B 13/00*** | (2006.01) |
| ***E04G 3/28*** | (2006.01) |

(52) U.S. Cl.

CPC ..... *E04G 23/002* (2013.01); *A46B 13/001* (2013.01); *A47L 1/02* (2013.01); *E04G 3/325* (2013.01); *A46B 2200/3073* (2013.01); *E04G 2003/286* (2013.01)

(58) Field of Classification Search

CPC ... A47L 1/02; A47L 11/38; A47L 3/00; A47L 3/02; A47L 3/04; A47L 1/00; E04G 23/002; E04G 23/004; B08B 1/002; B08B 1/008; B08B 1/04; B08B 13/00; A46B 13/001

USPC ..... 15/301, 302, 50.3, 52.1, 103

See application file for complete search history.

(56) References Cited

U.S. PATENT DOCUMENTS

| | | | | |
|---|---|---|---|---|
| 3,344,454 | A * | 10/1967 | Mikalson | A47L 1/02 15/50.3 |
| 5,249,326 | A | 10/1993 | Jefferies et al. | |
| 5,465,446 | A | 11/1995 | Chang | |
| 2009/0044833 | A1 | 2/2009 | Simonette | |
| 2013/0081902 | A1 * | 4/2013 | Liao | E04G 23/002 182/20 |
| 2014/0109932 | A1 | 4/2014 | Lange et al. | |

(Continued)

FOREIGN PATENT DOCUMENTS

| | | | |
|---|---|---|---|
| DE | 19849609 | A1 | 5/2000 |
| DE | 102016102272 | * | 8/2017 |

(Continued)

OTHER PUBLICATIONS

Partial machine translation of JP 3-159626, Jul. 1991 (Year: 1991).*

(Continued)

*Primary Examiner* — Laura C Guidotti

(74) *Attorney, Agent, or Firm* — Skaar Ulbrich Macari, P.A.

(57) ABSTRACT

An automated building washing device generally includes one or more rotational brushes having a vertical rotational axis coupled to a window washing swing stage. The brushes are horizontally movable from end-to-end along the longitudinal direction of a window washing swing stage while rotating about their vertical axis so that a relatively large portion of building surface can be quickly cleaned.

16 Claims, 10 Drawing Sheets

(56) References Cited

U.S. PATENT DOCUMENTS

| | | | | |
|---|---|---|---|---|
| 2018/0055298 | A1* | 3/2018 | Blake | B08B 1/04 |
| 2018/0055299 | A1 | 3/2018 | Blake et al. | |
| 2018/0140151 | A1* | 5/2018 | Mann | A47L 11/38 |

FOREIGN PATENT DOCUMENTS

| | | | | |
|---|---|---|---|---|
| JP | 3-159626 | * | 7/1991 | |
| JP | 2020-092800 A | * | 6/2020 | A47L 11/38 |
| WO | 2013105001 A2 | | 7/2013 | |

OTHER PUBLICATIONS

Computer generated English translation of JP 2020092800 A, Motochigawa, Jun. 2020. (Year: 2020).*

The International Search Report and Written Opinion rendered by the International Searching Authority for PCT/US2020/067070, dated Mar. 8, 2021, 9 pages.

* cited by examiner

AUTOMATED BUILDING WASHING APPARATUS

PRIORITY

This application claims the benefit of U.S. Provisional Application Ser. No. 62/953,864, filed on Dec. 26, 2019, which is hereby incorporated herein by reference in its entirety.

FIELD

The present invention relates generally to window washing devices and, more particularly, to automated washing devices for exterior surfaces of buildings.

BACKGROUND

Building structures, particularly tall urban buildings, were typically washed manually. In manual washing, a scaffolding structure (e.g., MHB-60 and MHB-80 models from Altrex, Sky Stage Ultra from Skyclimber, etc.) would be suspended from the top of the building to be washed. The scaffolding can be raised or lowered so that a person standing on the scaffolding can wash the windows and exterior surfaces of the building by hand. After a vertical section of the building is washed, the scaffolding is repositioned laterally so that the next adjacent vertical section of the building may be cleaned. This procedure was repeated until the entire building has been washed. This and other methods of manually cleaning windows of a building have proven to be extremely time consuming and labor intensive.

Manual washing of buildings is also unacceptably dangerous. Equipment can fail. Operators can misuse the equipment. And environmental conditions, such as wind and precipitation can make the cleaning operations more dangerous or even impossible. Thus, insurance rates for manual building cleaning businesses can comprise a significant portion (e.g. 40%) of labor costs.

Various types of automated window washing devices have been developed. For example, U.S. Pat. No. 7,665,173 discloses one such automated window washing device. The entirety of U.S. Pat. No. 7,665,173 is hereby incorporated herein by reference. The device shown in this patent is relatively large and heavy. This means that the apparatus must be transported in a large commercial size vehicle and there must be a team of operators to operate the device from remote positions. It also requires specialized rigging capable of lifting at least 2000 pounds. Thus it is best suited only for use on very large buildings such as skyscrapers. The power requirements of such large devices are also significant, which requires a dedicated power cable (typically 220V) to be connected the device.

Attempts have been made to adapt an automated washing apparatus to conventional swing stage scaffolding, which already exists on most buildings so that manual washing of the sides of the building can be performed, as indicated in U.S. Published Patent Application Nos. US20180055298A1 and US20180055299A1. However, such configuration has limited articulation of the brush, which limits cleaning speed because it requires a drop every 8-10 feet of building height, and a live operator is required to operate the washing device from the swing stage.

Therefore, there is an ongoing need to provide an automated cleaning device, system, and method that can be adapted to existing swing stage scaffolding that improves upon at least some of the drawbacks of the conventional technology.

SUMMARY

The present invention addresses the above-noted concerns regarding conventional building washing methods and automated machinery for the same.

In certain examples, a washing device and system may comprise one or more rotational brushes having a vertical rotational axis coupled to a window washing swing stage. The brushes are horizontally movable from end to end along the longitudinal direction of a window washing swing stage while rotating about their vertical axis so that a relatively large portion of building surface can be quickly cleaned.

In certain examples, an automated building washing apparatus can include a swing stage, a frame coupled to the swing stage, a first track coupled to the frame and a first brush rotationally coupled to the first track such that a rotational axis of the first brush is in a vertical axis and that the first brush can move horizontally between opposing longitudinal ends of the first track while rotating about the vertical axis.

In certain examples, an automated building washing assembly that can be retrofitted to an existing swing stage. The automated building washing assembly can include a frame adapted to be coupled to the swing stage, a first track coupled to the frame, and a first brush rotationally coupled to the first track such that a rotational axis of the first brush is in a vertical axis and that the first brush can move horizontally between opposing longitudinal ends of the first track while rotating about the vertical axis.

A second track can be coupled to the frame. A second brush can be rotationally coupled to the second track such that a rotational axis of the second brush is in the vertical axis and that the second brush can slide horizontally between opposing longitudinal ends of the second track while rotating about the vertical axis. The first brush and the second brush can be configured to slide in opposite directions from one another.

A control box can be disposed on the swing stage and contain control electronics for controlling operation of the first brush. The control electronics can be configured to increase a speed that the first brush moves across the track when a speed that the swing stage is ascending or descending a building surface being cleaned.

The swing stage can comprise a first longitudinal side to face a building surface to be cleaned and a second longitudinal side, opposite the first longitudinal side, that faces away from the building surface to be cleaned. A counterforce means, such as a fan or multiple fans, can be provided to the swing stage to push the first brush against the building surface to be cleaned.

The swing stage can define a deck that is sized to allow an adult human to walk between opposing longitudinal ends of the swing stage. The brushes can be located such that they do not impede the adult human from walking between opposing longitudinal ends of the swing stage when the brushes are rotated. For example, the brushes can be located entirely between the swing stage and a building surface to be cleaned.

A gyroscopic stabilizer can be provided to the swing stage.

A block stop can be provided to the swing stage and configured to be secured to a stabilization cable.

In certain examples, a method of washing a building can include spinning a first brush about a vertical axis and moving the first brush horizontally along a surface of the building while the first brush spins about the vertical axis. A vertical height of a swing stage to which the first brush is attached can be changed.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
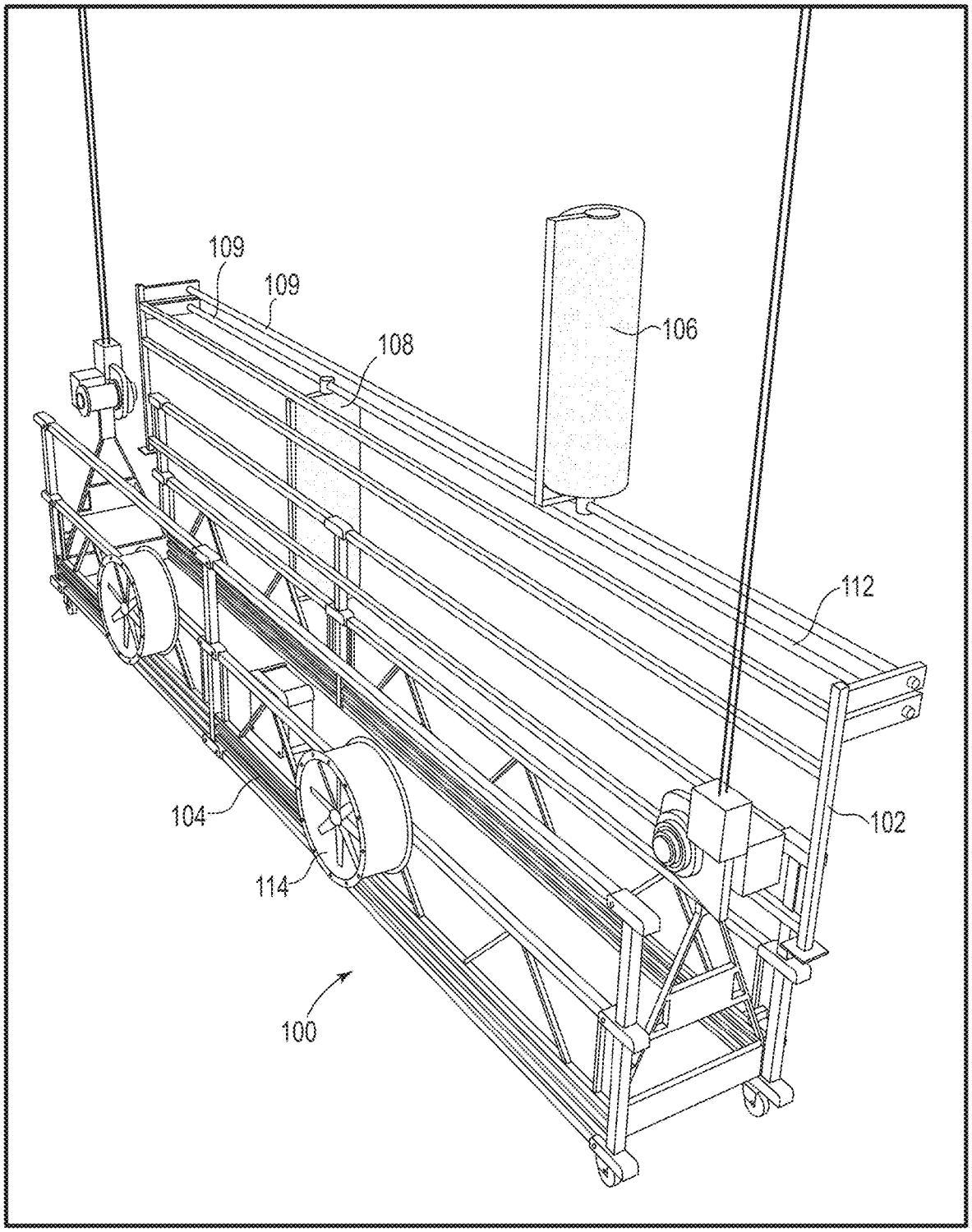
FIG. 1 is a perspective view of an automated building cleaning device in accordance with certain example embodiments.
Figure 2:
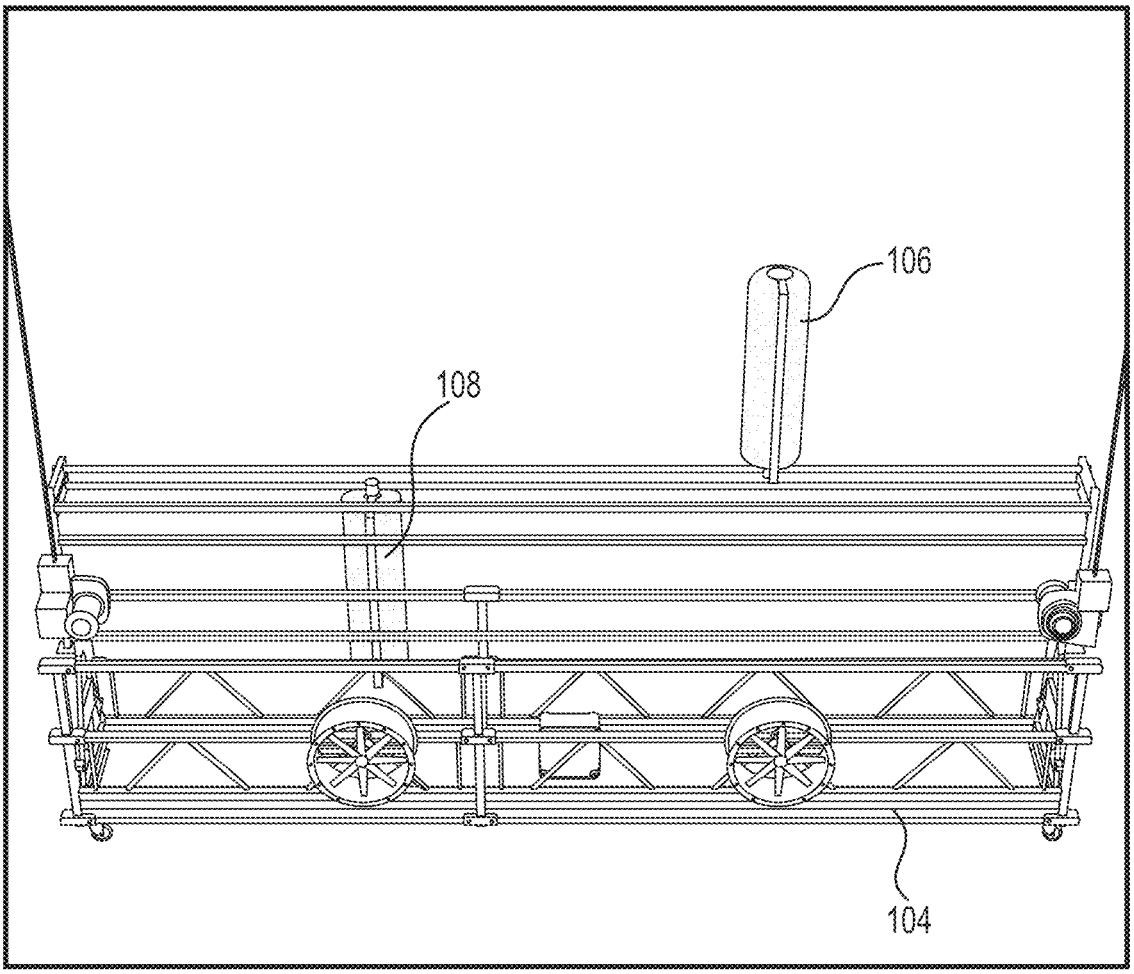
FIG. 2 is another perspective view of an automated building cleaning device in accordance with certain example embodiments.
Figure 3:
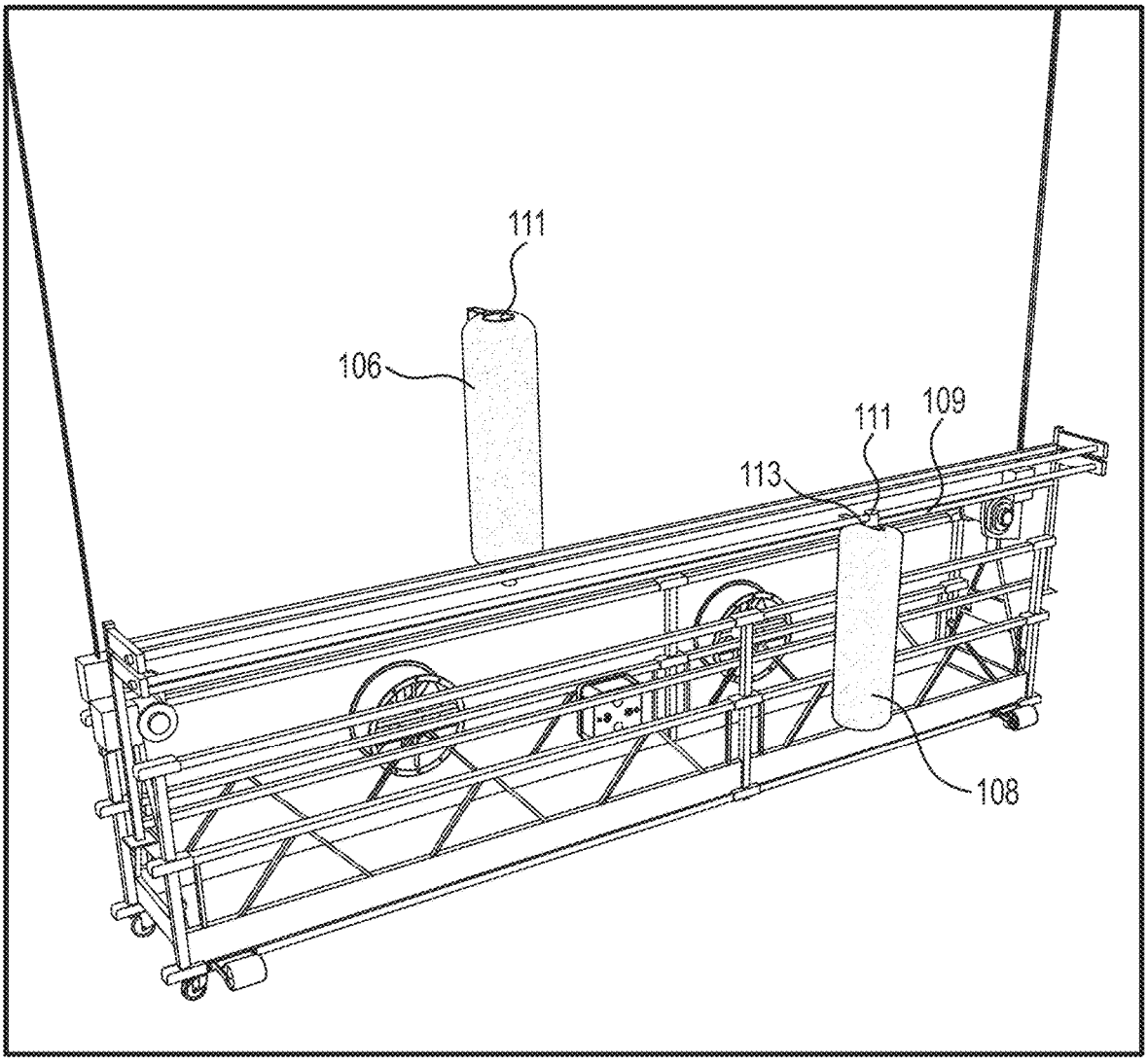
FIG. 3 is another perspective view of an automated building cleaning device in accordance with certain example embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention.

Referring to FIGS. 1-9, various views of an automated washing device 100 are shown. The washing device 100 generally comprises a frame 102 coupled to a suspended bucket, scaffolding or swing stage 104 (hereinafter inclusively described as swing stage). One or more washing brushes 106, 108 are coupled to the frame 102. Each brush 106, 108 is coupled such that the rotational axis of the brush is in the vertical axis. In addition, the brushes are mounted to a sliding track 109 so that they can slide linearly side-to-side in the horizontal plane. Such movement is along the longitudinal axis of the swing stage 104 and parallel to the exterior surface of the building that is being cleaned.

The frame 102 can be retrofitted to existing swing stages with mounting brackets. For example, the frame 102 is secured with fasteners to the top and bottom railings of the building side structural members of the swing stage. This can be seen, for example, in FIG. 4.

The brushes 106, 108 are attached to respective brackets 110 to provide the mounting points for the axles 111 of the brushes on either longitudinal end of the brushes 106, 108.

A motor 113 is coupled to the axle 111 of each brush 106, 108 to drive the rotation. The drive motor and coupling are configured similar to that used in the car wash art. The motor 113 can be integrated into or form the axle 111 as well.

Figure 10:
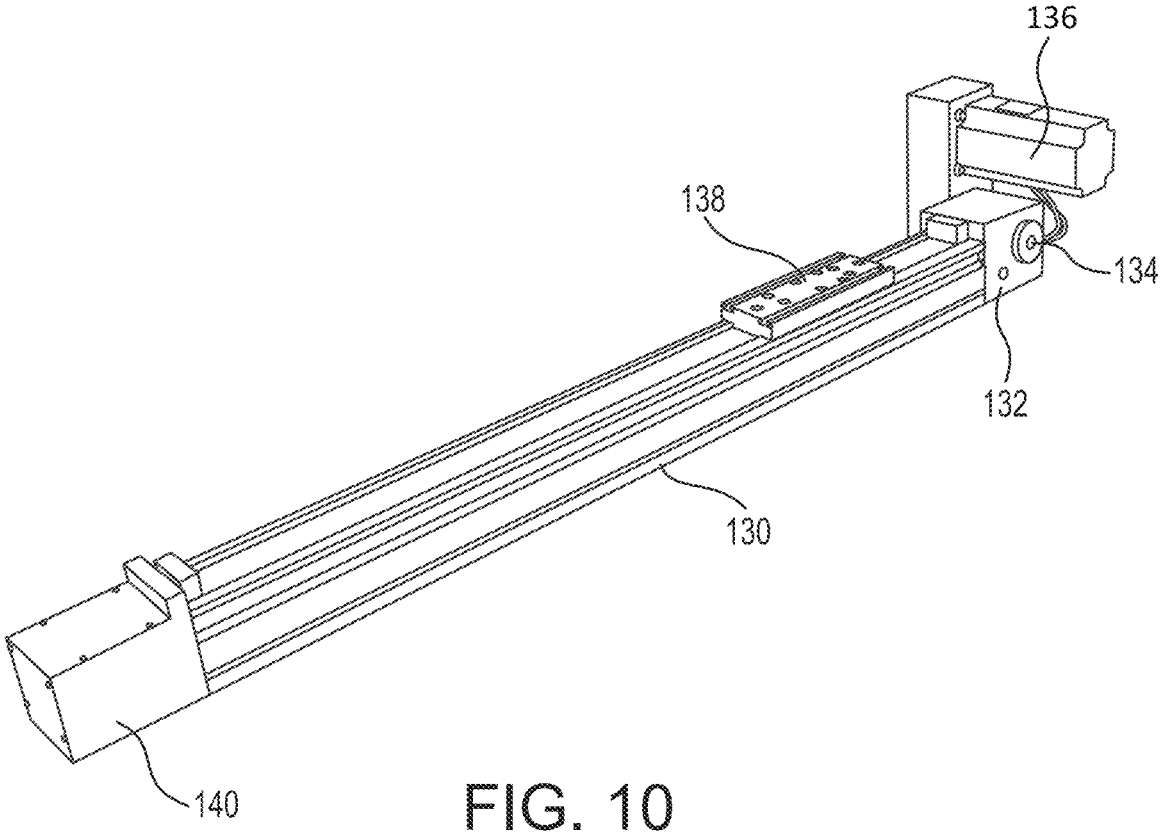
FIG. 10 is a perspective view of a rodless belt-drive actuator in accordance with certain example embodiments.

The brackets 110 are slidably mounted to horizontal track members 112 so that the brushes 106, 108 can slide horizontally from side-to-side (longitudinal end-to-end) of the swing stage while maintaining their vertical rotational axis. The longitudinal sliding movement is imparted in one embodiment via motors driving belts coupled to the brackets 110. For example, the rodless belt-driven actuator mechanism 130 shown in FIG. 10 can be used. This mechanism 130 uses a belt that wraps around an internal drive pulley on a drive end 132. The belt is connected to a drive shaft 134 that is connected to a shaft of a drive motor 136 to move a fitting 138 longitudinally along the longitudinal length of the actuator mechanism 130. On the opposite end (take-up end) from the drive end 132 is a pulley end 140 that houses a pulley to support the belt 132. The brush 106, 108 is coupled to the fitting 138 so that there is a controlled linear movement of the brush 106, 108 as the drive motor 136 moves the fitting 138.

Other sliding movement mechanisms can be provided in alternative embodiments. For example, an alternative sliding movement mechanism can be a rack and pinion electric actuator. A screw drive can also be used. Alternatively, the horizontal movement can be provided via gear drives or chain drives attached to the brackets 110, or via hydraulic actuators or pneumatic actuators.

Thrusters, such as fans 114 are mounted to the swing stage 104 on the long side opposite the building. The thrusters or fans 114 act as a counterforce means to push the swing stage (and thus the brushes 106, 108) against the building. The fans 114 can be variable speed so that the force pushing the brushes against the building is adjusted as needed to maintain a constant pressure of the brushes against the building surface. Sensors can be provided to the frame 102, such as long the vertical members 115, to measure the force on the brushes 106, 108 pushing against the building. The fan's speed (or the other counterforce means) can be automatically adjusted by a microcontroller coupled to the fan's drive motor and the sensor as needed to maintain a preset force minimum value and/or stay below a preset force maximum value.

Alternatively, or in addition to the fans, other means to keep the swing stage retained to the building (counterforce means) can be provided. For example, wheels or fittings protruding from the swing stage can travel in tracks defined on the surface of the building. Counterweights and stabilizing cables can also be provided. Other alternatives include use of suction cups that releasably grab onto the building surface.

A control box 116 is coupled to the swing stage 104. The control box 116 contains the control electronics for operating the motors to rotate and move the brushes 106, 108, as well as to operate the counterforce means such as the fans. The suspension cable motors 126 can also be controlled by the control electronics in the control box 116.

The control electronics disposed inside of the control box 116 can include a microprocessor that executes software code stored in a non-transitory memory. The control electronics can also be located remotely, such as on the building rooftop and a wired or wireless connection is formed with the components on the swing stage.

A remote control can also be provided to allow a user to remotely-operate the washing apparatus. The remote control allows an operator to manually control functions of the washing apparatus. The remote control can also be used to initiate and terminate automated washing routines. An antenna can be coupled to, or integrated into, the control electronics to receive commands from the remote control.

A stabilization cable 118 can be secured to the rooftop such as on the rigging for the swing stage 104. The stabilization cable 118 is coupled to a block stop 120 that is attached to the swing stage 104. This configuration aids in preventing the swing stage 104 from moving away from the building during a cleaning operation.

Suspension cables 122 for the swing stage 104 can be fastened to cable motors 124 disposed at the longitudinal ends of the swing stage 104.

Power for the motors that spin the brushes, slide the brushes and energize the onboard electronics can be provided by onboard batteries and/or via a power cable extending down or up the building to the control box 116.

The brushes 106, 108 are generally elongated cylindrical brushes comprising many individual filaments or fingers that radially extend outward from the central axis of rotation. The brush 106, 108 material can be the same material as used for car washes, including Neoglide foam, nylon, polyester, polypropylene, and hog's hair. Note that the brushes in some figures resemble stippled cylinders because the brushes are simplified for illustration purposes. Other suitable brush types can be provided that are known in the art.

The washing brush can also be changed out with a microfiber brush to dust the building without the need for cleaning solution or water.

The embodiment shown in FIGS. 1-5 comprises two brushes 106 and 108. A first brush 106 extends above the horizontal track members 112 and a second brush 108 extends below horizontal track members 112. The two brushes 106, 108 can move in opposite directions from one another. Both brushes can move at the same speed or one brush can move faster than the other. Spin speed can also be independently controlled on a per-brush basis.

In alternative embodiments, the automated washing device 100 can comprise just one of the first or second brushes. For example, the embodiment shown in FIGS. 6-7 comprises only one brush 106. In this example, the brush 106 extends downward so that it is essentially between the swing stage and the building surface. However, a single upwardly-extending brush could be provided in an alternative embodiment.

Figure 4:
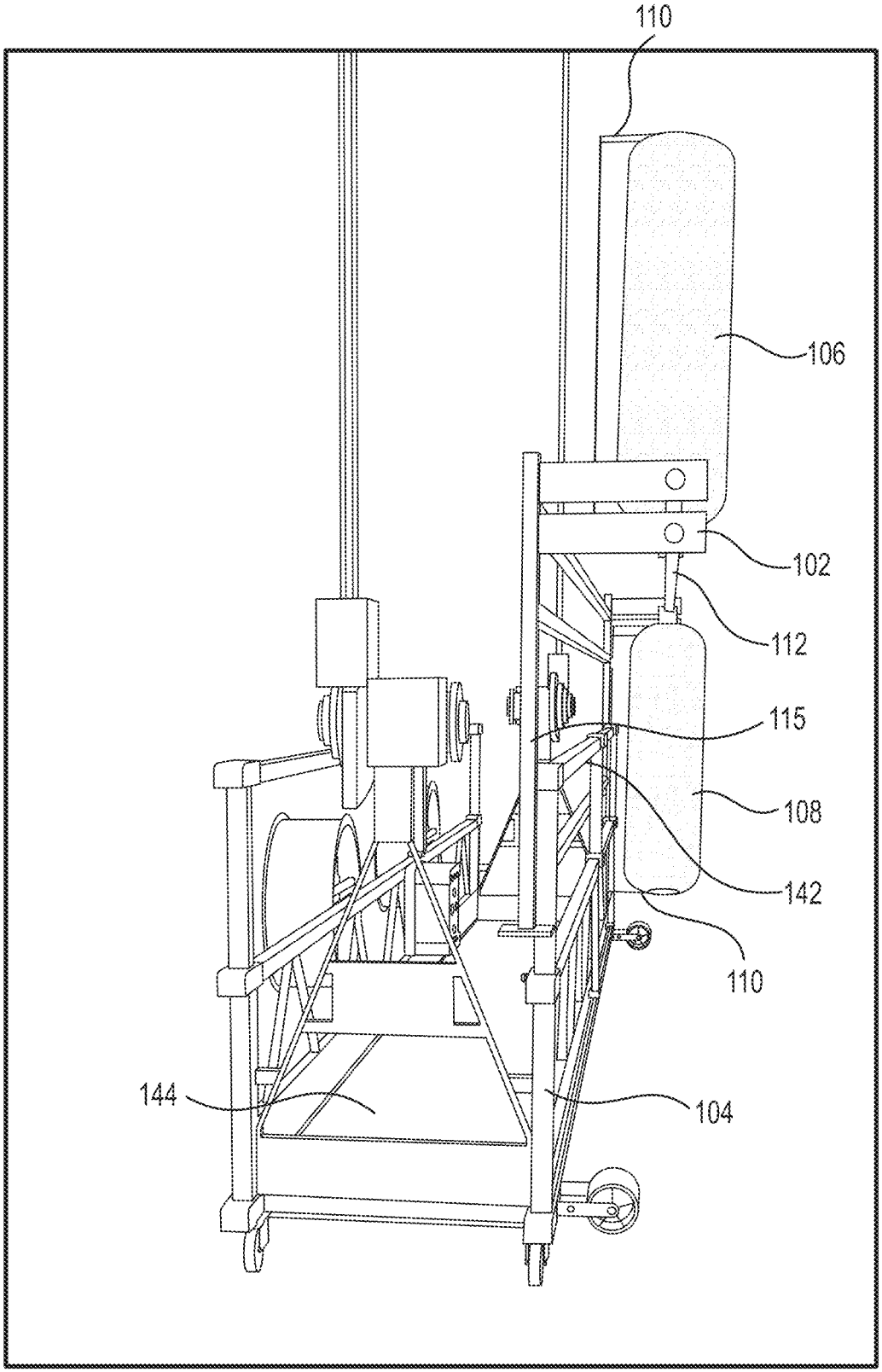
FIG. 4 is another perspective view of an automated building cleaning device in accordance with certain example embodiments.
Figure 5:
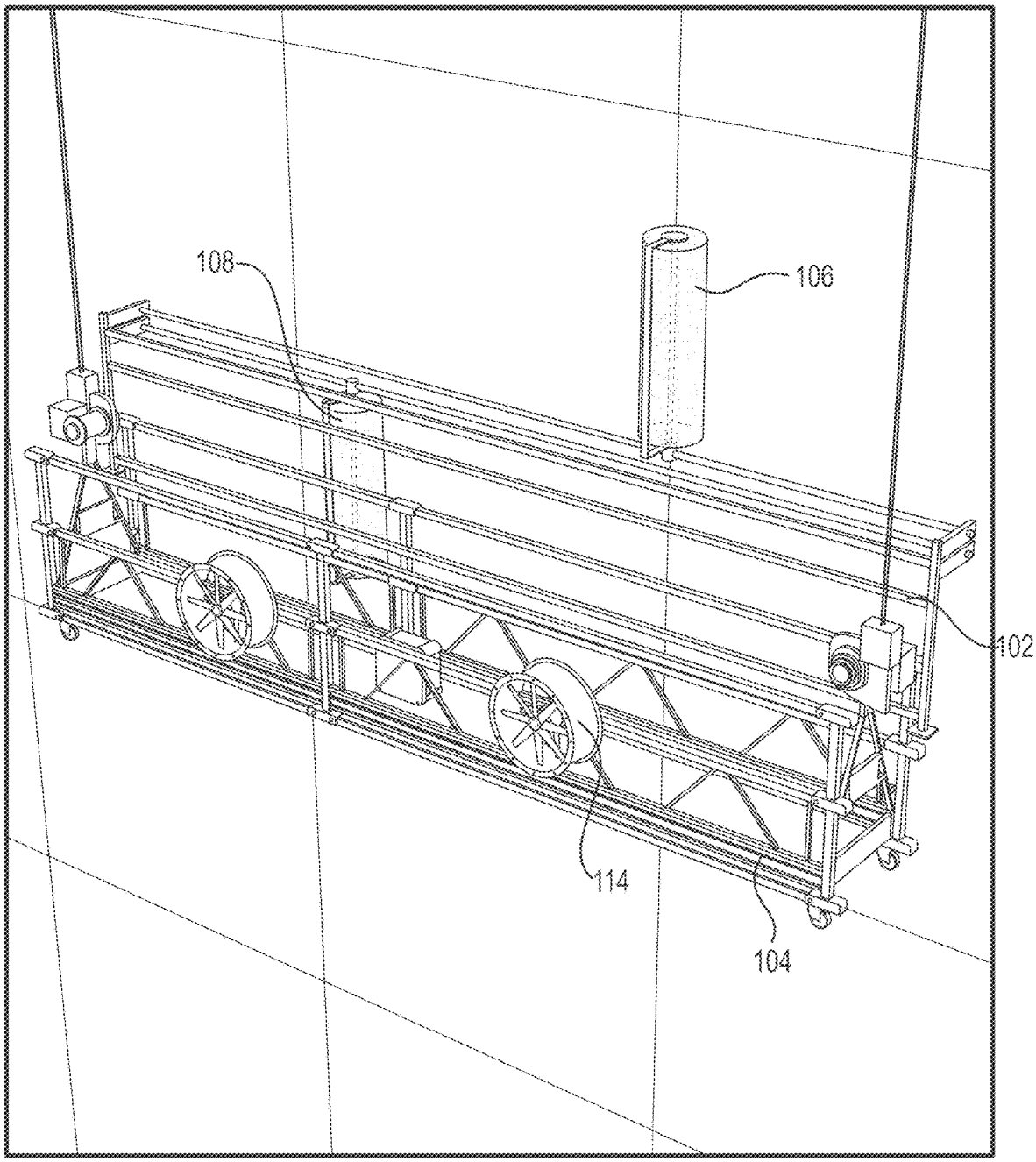
FIG. 5 is a perspective view of an automated building cleaning device shown against an exterior surface of a building in accordance with certain example embodiments.
Figure 6:
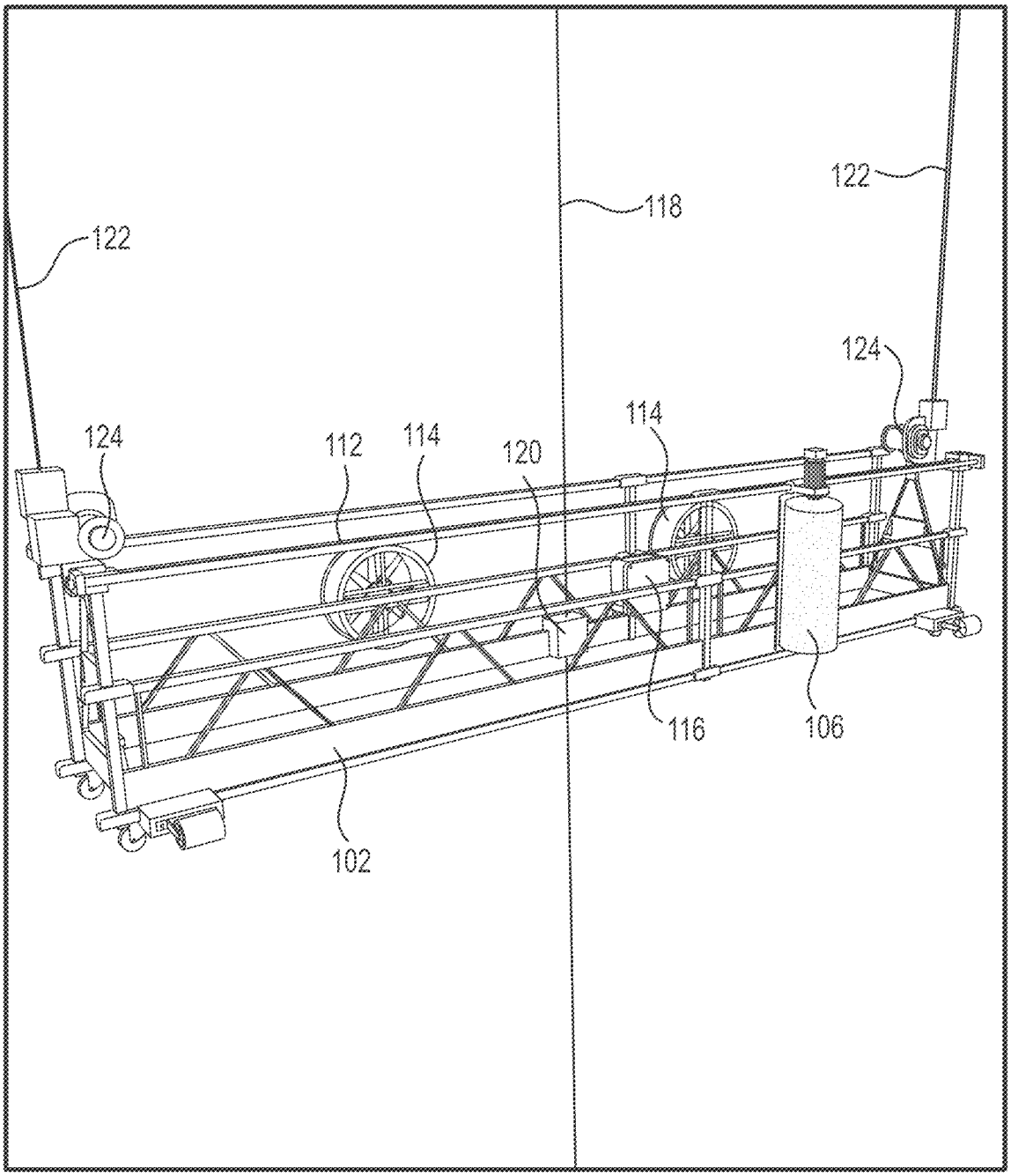
FIG. 6 is a perspective view of an automated building cleaning device in accordance with certain example embodiments.
Figure 7:
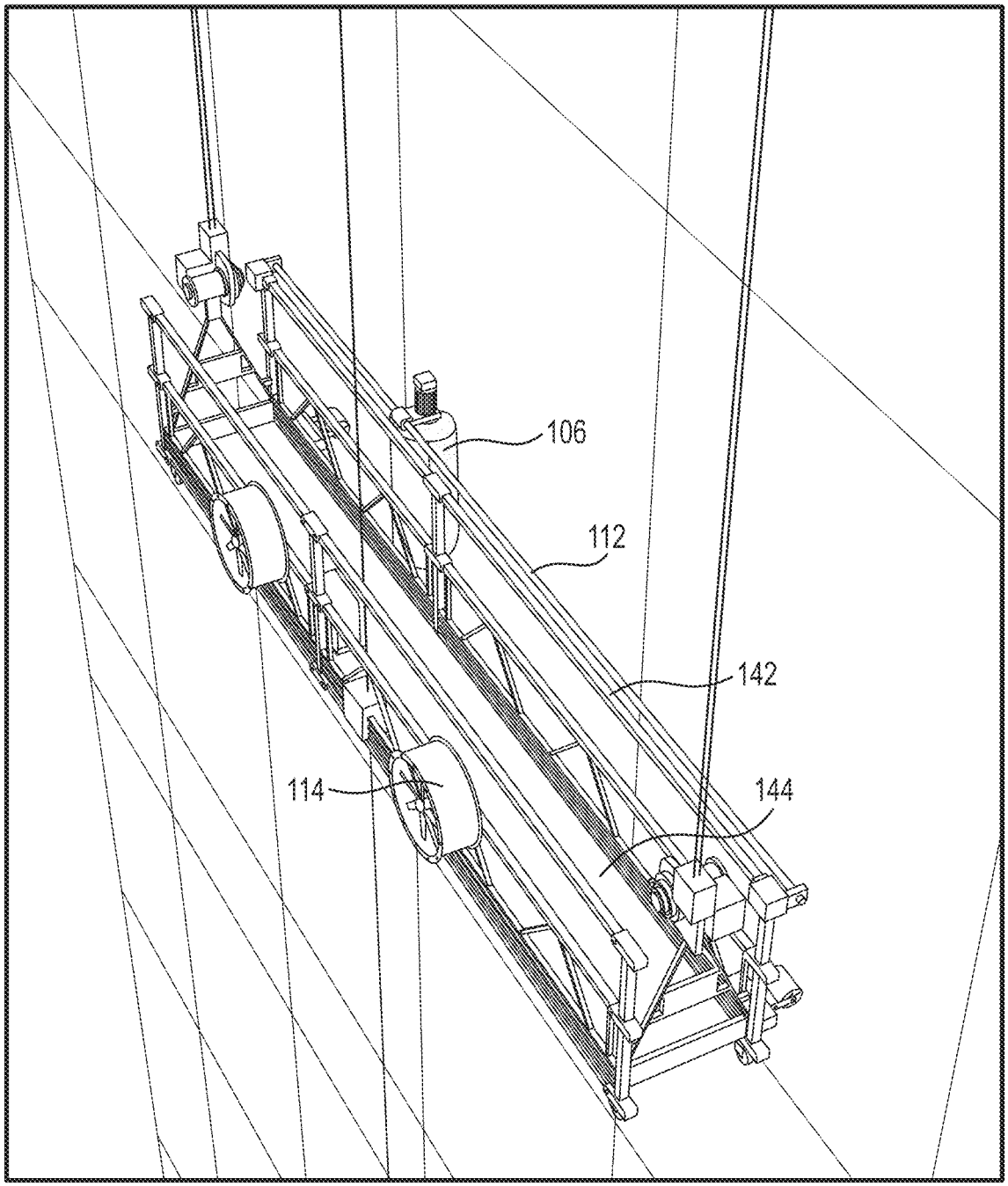
FIG. 7 is a perspective view of an automated building cleaning device shown against an exterior surface of a building in accordance with certain example embodiments.
Figure 8:
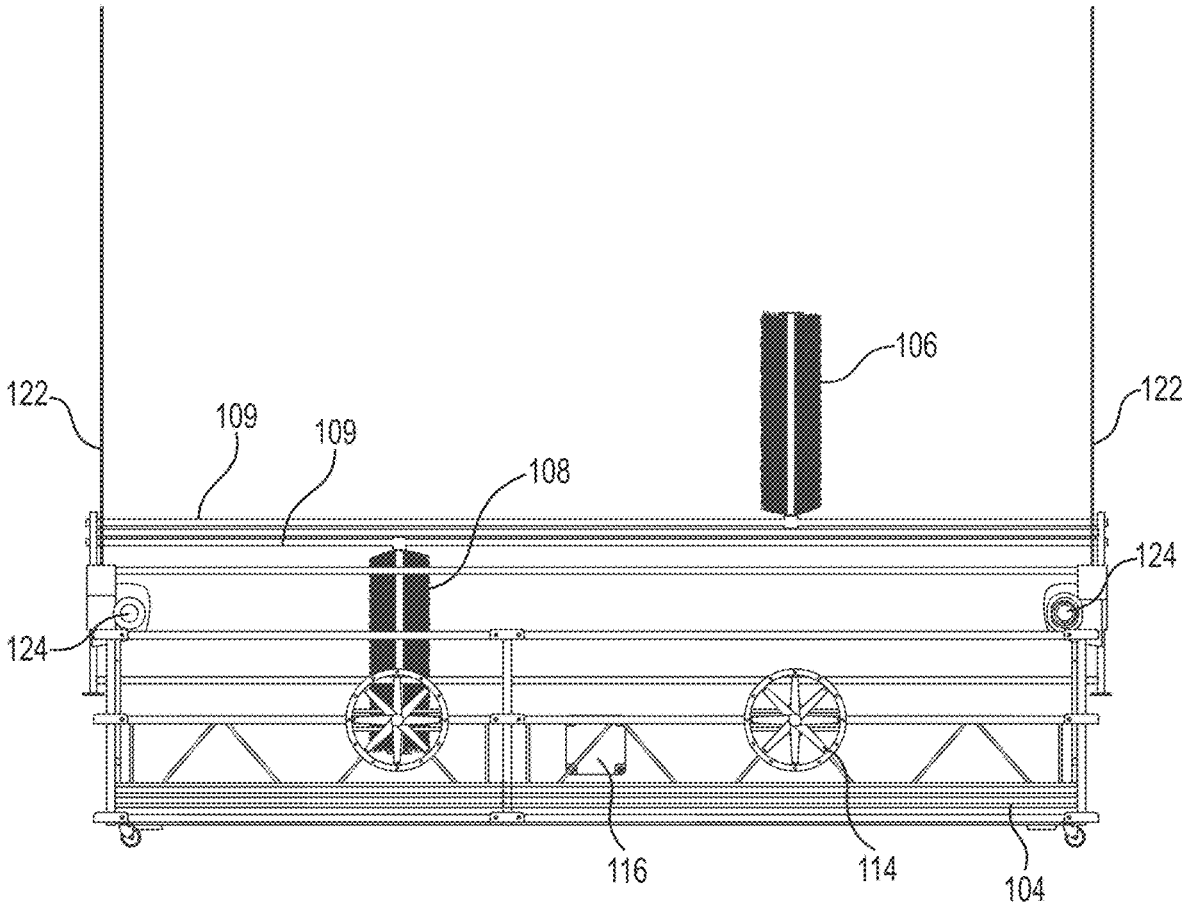
FIG. 8 is a front view of an automated building cleaning device in accordance with certain example embodiments.
Figure 9:
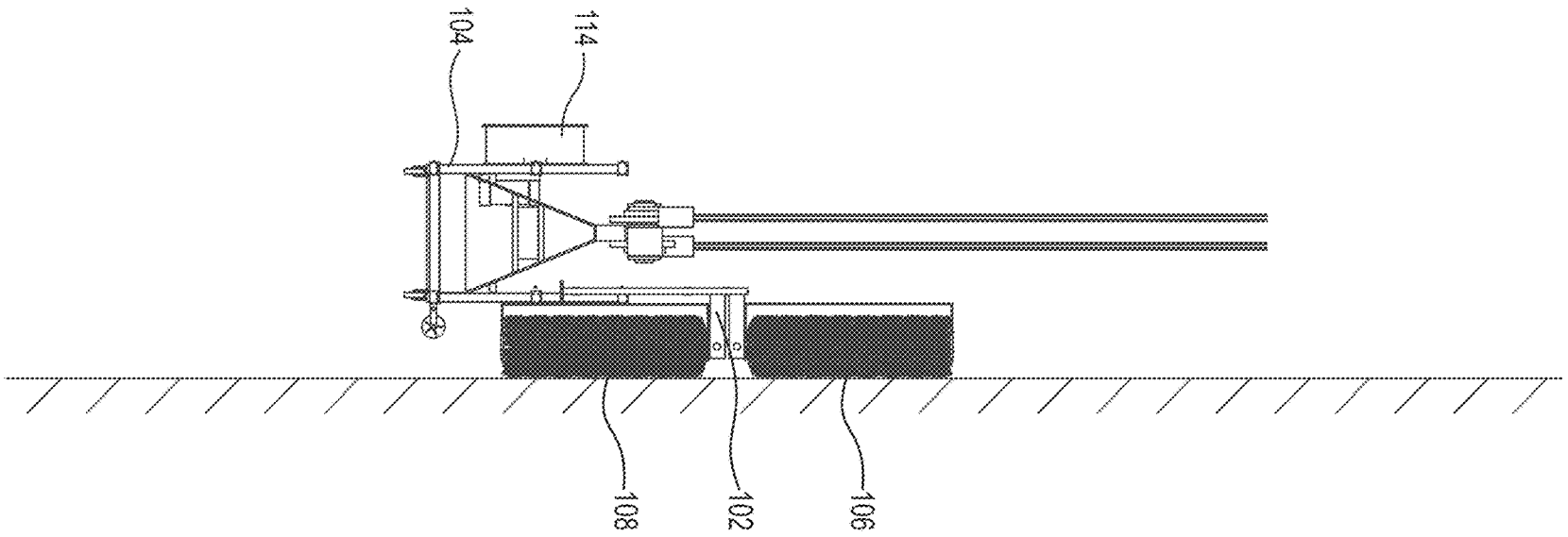
FIG. 9 is a side view of an automated building cleaning device shown against an exterior surface of a building in accordance with certain example embodiments.

As can be seen in FIGS. 4 and 9, the brushes 106, 108 are horizontally disposed so that the axis of rotation is between the swing stage and the building surface. Preferably the entire brush diameter is maintained outside of the perimeter of the swing stage rear rail 142 so that a person present on the swing stage does not contact the brush 106, 108 when walking on the deck 144 of the swing stage 104. Indeed, it is an advantage of certain embodiments that one or more persons can be present and walk unimpeded across and about the swing stage deck 144.

In a further alternative embodiment, there can be two brushes operating in the same sweep plane of the horizontal track members 112. In such embodiment, the brushes can move in opposing directions and cover a respective half of the horizontal track width, with a slight overlap in the middle of the track. Alternatively, both brushes can be disposed adjacent to one another and move together with a constant horizontal spacing maintained between the brushes.

In yet another embodiment, a brush spinning about a horizontal axis can replace one of the first 106 or second 108 brushes.

The frame 102, brush(es) 106, 108, brush motor(s) 113 and control electronics can be retrofit to existing swing stages.

The brush(es) is/are preferably spun by the rotational motor at a speed between 40 and 60 rotations per minute (in a low speed setting) or between 60 and 100 rotations per minute (in a high speed setting). The rotation direction can also be reversed and the RPM'S can be changed as desired. The control electronics can also vary the input power to dynamically to maintain a pre-set rotation speed of the brush. The control electronics can also employ an algorithm that increases brush rotation speed proportionate to the longitudinal slide speed for the brushes.

Spray nozzles such as those disclosed in U.S. Pat. No. 9,681,784 and US Patent Application Publication No. 2017/0145705 A1 can be disposed adjacent to the brushes 106, 108 and a cleaning solution reservoir can be disposed on the swing stage 104. The entirety of both U.S. Pat. No. 9,681,784 and US Patent Application Publication No. 2017/0145705 A1 is incorporated herein by reference.

A brush shroud can be provided that partially encircles each brush (e.g. as a half enclosure) as disclosed in both U.S. Pat. No. 9,681,784 and US Patent Application Publication No. 2017/0145705 A1.

A water containment baffle can also be provided to the swing stage to catch water or cleaning solution that falls from the brushes and drips from the building. The baffle can direct the water or solution that is caught by the baffle to an onboard holding tank that the user can periodically empty.

The water supply for cleaning can be supplied by the building being cleaned, such as a water supply line coupled to an outside water tap or spigot of the building. Alternatively, the water can be brought to the site in a storage tank. The storage tank can be onboard the swing stage 104 or remotely-located and coupled to the cleaning device 100.

The water can be converted to a cleaning solution by running it through a deionizing and reverse osmosis (DI/RO) water filter which takes most minerals out of the water. The DI/RO cleaning water can be held in a tank onboard the swing stage 104 or a supply hose can be run to the swing stage 104 from a remote location.

The DI water is sufficient to adequately clean the building and windows. Thus the cleaning process described herein is very environmentally friendly. However, chemicals or environmentally safe chemicals can be injected into the machine, if desired.

In a further aspect, the water ionization and filtering apparatus can be mounted onboard the cleaning machine 100. This allows the machine 100 to be simply connected to a tap water source and a separate ionizing and filter apparatus need not be provided.

In an additional aspect of the invention, one or more stabilizer gyros can be disposed on the swing stage 104 to provide for an additional or alternative means to reduce any desire of the swing stage to bounce or move away from contact with the building surface when in operation. Suitable stabilizer gyros such as the KS-4, KS-10 or KS-12 units are available from Kenyon Laboratories LLC, but other models and brands of gyro stabilizer can be used without departing from the scope of the invention. The stabilizer gyro can be mounted to the swing stage 104 with the axis of rotation aligned in a vertical direction. Thus, the stabilizer gyro(s) will resist any sudden motion of the swing stage 104 away from the building. The gyro(s) effectively operate as dampers on the frequency and amplitude of forces that would cause the cleaning machine 100 to move away from the building surface being cleaned. The rotational axis of the gyros can be adjusted to maximize this stabilizing effect.

In use, the swing stage 104, with the automated cleaning apparatus components and electronics disposed thereon, is lowered into position along an exterior surface of the building. The brushes 106, 108 are rotated about their vertical axes while they slide horizontally from side-to-side along the longitudinal length of their track 112 on swing stage 104. Cleaning water and/or cleaning chemicals are applied as desired. The thrusters, such as fans 114, are run to keep the brushes in contact with the building's surface. Stabilizing cables and/or gyros can also be used for the same purpose.

Once a section of the building is cleaned the swing stage is moved downward to the next section. Cleaning can also be performed by moving upward from a lower portion of the building. Once a vertical section of the building is cleaned, the swing stage is repositioned horizontally to a new vertical section of the building, which is then cleaned with the machine 100 as described herein. The process is repeated until the building is cleaned.

Alternatively, the cleaning apparatus 100 can be continuously moved downward/upward at a fixed speed as the building is being cleaned. The lateral sliding speed of the brushes 106, 108 is set fast enough such that at least some part of one of the brushes contacts all portions of the building in the vertical cleaning section.

More than one automated cleaning apparatus 100 can be used to clean a single building.

The automated cleaning apparatus can be retrofitted to exiting swing stage installations. The swing stage can still be used in a conventional manner however. The automated cleaning apparatus can also be mounted to other apparatus such as a boom truck or a scissors lift.

One or more persons can occupy the swing stage while it is operating, or the swing stage can be operated autonomously without an operator present. The brush assemblies and drive components can be easily accessed by operators during operation.

The automated cleaning apparatus 100 can be remotely operated so that no persons need be present on the swing stage. In these unmanned embodiments, the automated cleaning apparatus 100 is also operated remotely.

One or more cameras can be mounted to the automated cleaning apparatus or to the swing stage so that remote operation can be monitored by the operator or by others that are located in a remote location. The cameras can also be used to confirm that the building was correctly cleaned.

In dual brush configurations, the brushes 106, 108 can rotate and slide horizontally opposite each other (e.g., one slides right as the other slides left) for optimum stability. The brushes pass by each other in the approximate longitudinal mid-point of the swing stage.

The horizontal track members 112 can extend (or be adjusted to extend) longitudinally beyond the opposing longitudinal ends of the swing stage to increase the horizontal cleaning sweep area.

The sweep area can be adjusted or limited as needed by limiting the horizontal travel of the brushes to only a certain range along the track members 112.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. An automated building washing apparatus, comprising:
- a swing stage;
- a frame coupled to the swing stage;
- a first track coupled to the frame;
- a second track coupled to the frame;
- a first brush rotationally coupled to the first track such that a rotational axis of the first brush is in a vertical axis and that the first brush can move horizontally between opposing longitudinal ends of the first track while rotating about the vertical axis; and
- a second brush rotationally coupled to the second track such that a rotational axis of the second brush is in the vertical axis and that the second brush can slide horizontally between opposing longitudinal ends of the second track while rotating about the vertical axis.

2. The automated building washing apparatus of claim 1, wherein the first brush and the second brush are each configured to slide in opposite directions from one another.

3. The automated building washing apparatus of claim 1, further comprising a control box disposed on the swing stage, the control box comprising control electronics for controlling operation of the first brush.

4. The automated building washing apparatus of claim 3, wherein the control electronics are configured to increase a speed that the first brush moves across the track when a speed that the swing stage is ascending or descending a building surface being cleaned is increased.

5. The automated building washing apparatus of claim 1, wherein the swing stage comprises a first longitudinal side to face a building surface to be cleaned and a second longitudinal side, opposite the first longitudinal side, that faces away from the building surface to be cleaned, the automated building washing apparatus further comprising a counterforce means to push the first brush against the building surface to be cleaned.

6. The automated building washing apparatus of claim 5, wherein the counterforce means is a fan.

7. The automated building washing apparatus of claim 1, wherein the first brush is located entirely between the swing stage and a building surface to be cleaned.

8. The automated building washing apparatus of claim 1, wherein the swing stage defines a deck that is sized to allow an adult human to walk between opposing longitudinal ends of the swing stage, and wherein the first brush is located such that the first brush does not impede the adult human from walking between opposing longitudinal ends of the swing stage when the first brush is rotated.

9. The automated building washing apparatus of claim 1, further comprising a gyroscopic stabilizer provided to the swing stage.

10. The automated building washing apparatus of claim 1, further comprising a block stop provided to the swing stage and configured to be secured to a stabilization cable.

11. An automated building washing assembly that can be retrofitted to a swing stage, the automated building washing assembly comprising:

a frame adapted to be coupled to the swing stage;

a first track coupled to the frame;

a second track coupled to the frame;

a first brush rotationally coupled to the first track such that a rotational axis of the first brush is in a vertical axis and that the first brush can move horizontally between opposing longitudinal ends of the first track while rotating about the vertical axis; and a second brush rotationally coupled to the second track such that a rotational axis of the second brush is in the vertical axis and that the second brush can slide horizontally between opposing longitudinal ends of the second track while rotating about the vertical axis.

12. The automated building washing assembly of claim 11, further comprising a control box disposed on the swing stage, the control box comprising control electronics for controlling operation of the first brush, wherein the control electronics are configured to increase a speed that the first brush moves across the track when a speed that the swing stage is ascending or descending a building surface being cleaned is increased.

13. The automated building washing assembly of claim 11, wherein the swing stage comprises a first longitudinal side to face a building surface to be cleaned and a second longitudinal side, opposite the first longitudinal side, that faces away from the building surface to be cleaned, the automated building washing apparatus further comprising a counterforce means to push the first brush against the building surface to be cleaned.

14. The automated building washing assembly of claim 11, wherein the first brush is located entirely between the swing stage and a building surface to be cleaned.

15. The automated building washing assembly of claim 11, wherein the first brush is located such that the first brush does not impede an adult human from walking between opposing longitudinal ends of the swing stage when the first brush is rotated.

16. The automated building washing assembly of claim 11, further comprising a gyroscopic stabilizer provided to the swing stage.

* * * * *